United States Patent [19]

Halverson

[11] 4,361,960

[45] Dec. 7, 1982

[54] CHAIN SAW BAR WITH AUTOMATIC TENSIONING

[76] Inventor: James E. Halverson, Rte. One, Box 40, Hillsdale, Wis. 54744

[21] Appl. No.: 209,754

[22] Filed: Nov. 24, 1980

[51] Int. Cl.[3] ..... B27B 17/12; B27B 17/14

[52] U.S. Cl. ..... 30/385; 30/123.4; 30/387; 83/818

[58] Field of Search ..... 30/384, 385, 386, 387, 30/383, 123.4; 83/818

[56] References Cited

U.S. PATENT DOCUMENTS

| | | | |
|---|---|---|---|
| 2,316,997 | 4/1943 | Smith | 30/385 |
| 2,532,981 | 12/1950 | Wolfe | 30/385 |
| 2,765,821 | 10/1956 | Strunk | 30/386 |
| 3,279,508 | 10/1966 | Ehlen | 30/385 |

FOREIGN PATENT DOCUMENTS

| | | | |
|---|---|---|---|
| 493111 | 5/1953 | Canada | 30/386 |

*Primary Examiner*—Jimmy C. Peters

*Attorney, Agent, or Firm*—Merchant, Gould, Smith, Edell, Welter & Schmidt

[57] ABSTRACT

A chain saw guide bar assembly (30) having improved automatic chain tensioning, vibration damping and lubrication properties, and related lubrication methods are provided. A nose guide member (34) rotatably carrying an idler sprocket (34.1) is mounted to an elongate primary guide bar member (32) for reciprocal longitudinal movement relative thereto. Biasing spring members (50, 51) acting on force-imparting surfaces (60.4, 60.5), are protectively enclosed within an internal cavity (33) of the primary guide member and bias the nose guide member with predetermined tensioning force in the longitudinal direction against an endless cutting chain (40). An interchangeable force block member (60) enables preselection of the desired chain tension force. Damping finger members (32.35, 32.36, 50, 51) cooperatively absorb vibratory forces transmitted through the guide bar. Oil passageways (32.33, 32.34, 39) longitudinally extend through the guide bar to provide complete lubrication of the biasing means, the idler sprocket and other moving parts of the bar assembly and to provide improved lubrication of the cutting chain at a position adjacent the juncture of the two guide members comprising the bifurcated guide bar. Method steps for lubricating the cutting chain and the idler sprocket from oil transmitted through the length of the guide bar are also provided.

32 Claims, 12 Drawing Figures

34
34.5
50.1
51.1
32.35
34.7
50
34.8
51
7
8
32.12
60.5
33
60.4
60.3
60
32.36
32.31
60.1
60.2
32.32
32.35
32
32.3
32.1
32.33
32.34
32.11
36a
36b
32a
40
100

32.3
32.1
50.1
34.8
39
51.1
51
32.36b
34.7
32.35a
32.35b
50
50.3
51.3
32.36a
32.36
32.12
33
50.2
51.2
A
60.4
60.6
60.5
60.3
32.31
60.1
60.2
60
B
32.32
32.33
32.34
100

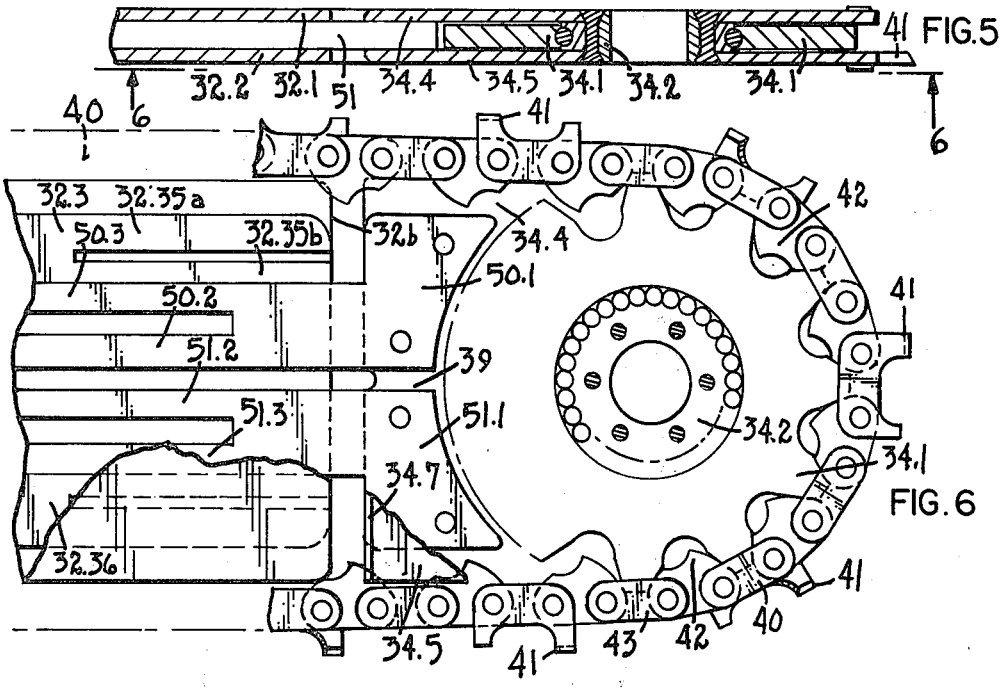
FIG.5
FIG.6
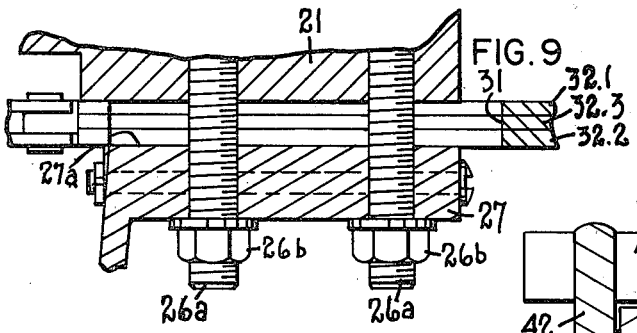
FIG. 9
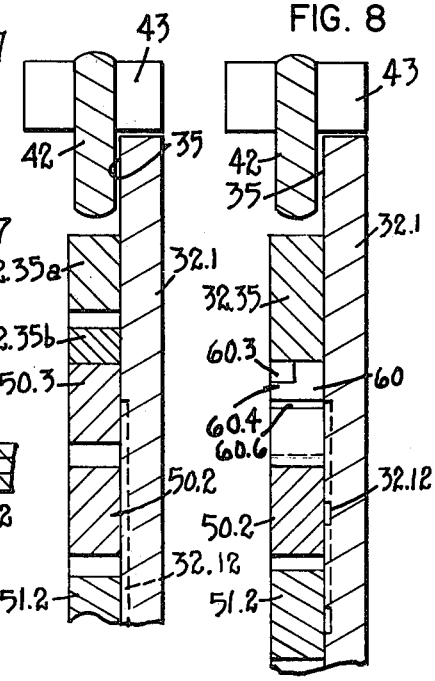
FIG. 7
FIG. 8
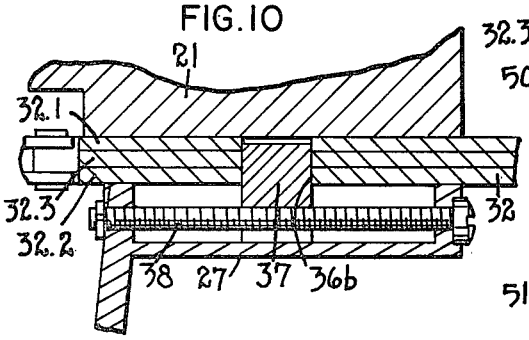
FIG.10

CHAIN SAW BAR WITH AUTOMATIC TENSIONING

CROSS REFERENCES

This application replaces Disclosure Document No. 090,178 filed by the inventor hereof in the United States Patent and Trademark Office on Apr. 20, 1980.

TECHNICAL FIELD

This invention relates broadly to chain saws. More particularly, this invention relates to a chain saw bar structure having improved tensioning apparatus for automatically maintaining uniform tension to the cutting chain guided by the bar while significantly reducing operative vibration in the chain saw. The invention further incorporates an improved chain saw bar structure and method for lubrication of the cutting chain and moving parts of the bar assembly.

BACKGROUND OF THE PRIOR ART

Due to their ease of operation, cutting speed, lightweight and high versatility, the portable powered chain saw has today virtually replaced the one and two man blade saws previously used for felling and trimming trees in the lumber and logging industries. Likewise, in the private consumer market, from the professional and occasional tree trimmer to the homeowner cutting his own fireplace or furnace wood, the chain saw has become a modern day necessity. Such wide spread and versatile use demands have emphasized more than ever the need for chain saws with improved reliability, safety, versatility and efficiency in operation.

Depending upon the size of the wood severing operation to be performed by the chain saw, its size and power rating will vary. However, such chain saws customarily include a lightweight driving motor, typically a small gasoline powered engine, an elongated guide bar extending in cantilevered manner out from the motor, and an endless articulated chain carrying spaced cutting members thereon which serve as the cutting blade for the saw. The guide bar and chain are cooperatively designed such that the chain moves or tracks along the periphery of the guide bar and is looped over a sprocket aligned at the motor end of the guide bar, which sprocket is driven by the motor. When the motor is operated so as to drive the sprocket, the sprocket pulls the endless cutting chain along the periphery of the guide bar, moving the cutting members therealong. A cutting or sawing operation is performed by positioning the guide bar in proximity with an object such that the moving cutting members engage the object at the desired "cut" position, thus severing upon contact therewith small particles from the object.

The theory of operation of such chain saws is very simple. However, due to the fact that in operation, the cutting chain is constantly moving in frictional engagement with the underlying guide bar, chain saws have historically been very difficult to keep operating at maximum efficiency for any extended usage without requiring frequent re-adjustment in the field. Such re-adjustment, besides being burdensome on the operator, reduces the time that could otherwise be devoted to cutting operations, often requires the operator to carry an adjustment tool kit with him, and leaves entirely to the judgment of the operator the decisions as to when, in what manner, and to what extent, such adjustments will be made. Failure to make timely or proper adjustments can result in a safety hazard to the operator with further operation of the saw, as well as reducing the efficiency, reliability, and longevity of the chain saw and its component parts.

The primary parameter responsible for the adjustment problem is the tension of the cutting chain relative to the guide bar. The tension must be sufficiently "tight", such that the chain will stay within the peripheral guide track of the guide bar. Obviously, if the chain tension is too loose, the chain can jump out of the guide bar track, causing a dangerous situation to the operator. A loose saw chain will typically continue to "travel" within the guide track even when the drive sprocket is not being driven. This can create a very dangerous condition to the operator of the saw, or to onlookers. It has also been found that a loose chain will "slap" the guide bar to such an extent during operation of the saw, that it will actually flange or roughen the engaging surfaces of both the chain and the guide bar, thus requiring more power from the drive motor to overcome the increased friction. If the chain tension is set too tightly, the frictional forces between the chain and the guide bar will cause excessive early wear on the chain and the guide bar as well as causing over-heating of the cutting chain and can cause the chain to bind in the guide bar, resulting in a dangerous situation to the operator should the chain break as a result thereof. Such over-heating of the chain also results in loss of temper in its cutting teeth, necessitating frequent filing or sharpening of the teeth by the operator.

While the necessity of proper chain saw tension has long been recognized in the art, the ability to maintain the desired uniformity of such tension over extended periods of operative use, has not been realized. While a chain tension may be properly set prior to use of the chain saw, the tension will change as the saw is operated over a period of time. Many factors contribute to the change. One of the primary factors affecting such change is the difference in the temperature coefficients of expansion between the cutting chain and the guide bar materials. As the guide bar and cutting chain heat up during cutting operations, the chain material typically expands faster than that of the guide bar, causing the chain tension to slacken. The result can cause a snowballing effect (i.e. the decreased chain tension causes even greater frictional drag forces on the chain during the cutting operations due to normal operation and due to the chain and guide bar deterioration that results from chain "slap", which further increases the temperature, and contributes even more to the decrease of tension). Other factors such as the sharpness and alignment of the chain cutting members, the environment (i.e., wet snow, dry, etc.) in which the saw is being used, the type, consistency and nature of the wood or other object being cut, the proper oiling of the chain, use and misuse by the operator, and the like—all contribute to the problem of maintaining proper cutting chain tension in operative use.

Thus, in order to prevent the chain from loosening and from possibly jumping out of the guide bar track, the operator must interrupt his cutting operations to reset the tension of the expanded chain. An impatient operator may try to minimize the number of times he should re-adjust the chain tension, by overtightening the chain, resulting in a dangerous chain binding situation. Obviously, should the operator ever take a rest of sufficient length to enable the chain to cool, its length will shorten during the rest interval, rendering the chain tension too tight upon resumption of cutting operations. Similarly, even under continuous cutting operations, should the conditions under which the saw is being used abruptly change, (i.e., such as a change in the type or consistency of the wood being cut) so will the temperature effect upon the cutting chain—again requiring resetting of the chain tension.

Heretofore, attempts have been made in the prior art, to address the tensioning problem. None of such attempts, however, have resulted in devices which eliminate the periodic tensioning adjustment of the saw chain or which are economically practical, and adapted to the rugged and varied uses to which chain saws are typically put. For example, the prior art recognizes the advantage of altering the guide bar structure to place a free-wheeling sprocket or pulley at the distal (nose) end of the guide bar, thus reducing the frictional drag of the chain against the guide bar at its distal end. U.S. Pat. No. 3,279,508 to Ehlan et al illustrates a variation of this concept.

A number of patents have dealt specifically with providing simplified means for performing the tensioning adjustment procedure in the field. See for example, U.S. Pat. Nos. 2,765,821 to Strunk, 3,327,741 to Merz, and 3,267,973 to Beard. Each of these patents illustrates a tensioning mechanism whereby once the proper tension is set, the guide bar is rigidly secured to the primary chain saw chassis until subsequently manually readjusted.

Attempts have been made in the art to provide continuous automatic tensioning adjustment to the cutting chain. See for example, U.S. Pat. Nos. 2,316,997 and 2,532,981 to Smith and Wolfe, respectively. Both of the structures illustrated by these patents employ a bifurcated guide bar wherein the rearward portion of the guide bar is rigidly secured to the primary chain saw chassis, and the distal end of the bifurcated bar is resiliently mounted under spring tension into engagement with the cutting chain, to adjust for tension variations in the cutting chain. While the basic theory behind these configurations is sound, neither of the structures illustrated was refined to the point of being commercially economical or operatively practical for use in the rugged environments in which chain saws are typically used. One particular shortcoming of these structures is their exposure of critical elements to damaging external environments. The exposed parts are inherently susceptible to moisture deterioration and seizing (due to rust) as well as to physical damage and degradation.

More recent developments in the art have abandoned the bifurcated guide bar approach in favor of configurations which apply tension adjusting forces to a single guide bar that is reciprocally mounted to the primary chain saw chassis. See for example U.S. Pat. Nos. 3,194,284 and 3,636,995 to Walker and Newman, respectively. Reliability and accuracy of such tensioning structures, however, is severely strained by the transmittal of large leverage forces thereto through the elongate guide bar. Such structures also typically display poor transfer of lubricating oil from the oil reservoir on the drive unit, to the moving chain. Further, the resilient mounting of the guide bar in such structures does little to minimize and may enhance vibratory forces inherently present in the chain saw operation. A further shortcoming of such structures is that they are typically peculiar to the particular chain saw frame or chassis used, and do not lend themselves universally applicable to chain saw guide bars that can be used with the existing chassis configurations of a number of different manufacturers.

The present invention comprises a composite structure which overcomes, in one device, most of the collective shortcomings of the prior art tensioning structures. The guide bar and tensioning structure of the present invention maintain a constant, uniform tension on the cutting chain. The guide bar and tensioning structure of the present invention are simple, structurally reliable and offer shock absorption properties that significantly reduce the operative vibration typically found in prior art chain saws. Chain and guide bar wear are significantly reduced, thus increasing their operative lives. With the maintenance of proper tensioning provided by the inventive structure, the motor/engine efficiency of the saw is significantly increased, since more of the drive power is available for the task of cutting, rather than being spent in overcoming frictional and mis-alignment forces heretofore present in the cutting operation. Fuel consumption of the saw is accordingly reduced, for a given cutting task, and operator efficiency is increased due to the elimination of non-productive time heretofore required to periodically adjust the cutting chain tension and to prematurely resharpen the cutting teeth of the chain. Operator fatigue is reduced due to the lower vibration levels displayed by the chain saw, and cumbersome adjustment tool kits and lubricating grease guns are eliminated with the present invention. The structure of the present invention can be universally adapted to fit the saw chassis configurations of most chain saw manufacturers currently in the field. Critical moving parts are shielded from damaging external environments, while improved lubrication techniques significantly enhance their operation, reduce wear and increase reliability.

SUMMARY OF THE INVENTION

The present invention comprises apparatus and methods for significantly increasing the operable life of chain saw guide bars and the cutting chains moving therealong. The present invention further provides improved operator efficiency and comfort by providing an automatic cutting chain tensioning structure that maintains a uniform chain tension over extended periods of chain saw use, while significantly reducing the vibration heretofore typically present in the operation of chain saws constructed according to teachings of the prior art. The present invention provides an improved chain saw guide bar assembly for use with a chain saw of the type having an endless toothed chain, a frame, a drive sprocket rotatably mounted on the frame and supporting the chain, and means for mounting the guide bar assembly to the frame in a manner such that the chain is guided by and moves along the periphery of the guide bar assembly in response to rotation of the drive sprocket, by an appropriate engine or motor prime mover.

The invention relates primarily toward a guide bar assembly having a bifurcated guide bar, including an elongated primary guide member and a nose guide member. The primary guide member longitudinally extends along an axis between proximal and distal ends. The proximal end of the primary guide member is configured for mounting to the chain saw frame adjacent the drive sprocket such the body portion of the primary guide member extends from the frame in cantilevered manner outwardly toward the distal end thereof. The nose guide member is configured to form an operative extension of the primary guide member at the distal end thereof. Means are provided for moveably connecting the nose guide member to the primary guide member at its distal end such that when operatively connected, the nose guide member will move relative to the distal end of the primary guide member, but substantially only in the axial direction of the primary guide member. When operatively connected, the cutting chain is entrained along the outer peripheries of the primary and the nose guide members and moves therealong under the direction of the drive sprocket. The bifurcated guide bar includes biasing means enclosed within the guide bar for automatically applying uniform tensioning forces to the cutting chain by controllingly urging the nose guide member outwardly in the axial direction, away from the distal end of the primary guide bar member. The biasing means is protectively shielded from the external environment of the bifurcated guide bar during operation, thus ensuring accurate and reliable operation thereof.

The biasing means can assume a number of varied configurations wherein the primary biasing element typically comprises a spring-like member acting against a force-imparting bearing surface so as to controllably urge the primary guide member and the nose guide member away from each other, as restrained by the endless chain entrained around their outer peripheries. Further, the spring member can be housed either within the primary guide member or within the nose guide member. In either case, since it is desirable to maintain the thickness of the guide bar as thin as possible, and to a dimension less than the cutting width of the cutting teeth of the chain member, the spring member is preferably constructed from a sheet-like spring member that can easily be placed within an internal cavity of either the primary guide bar member or the nose guide member. Obviously, depending upon the positioning and orientation of the spring member within the guide bar assembly, the force-imparting bearing surfaces will be positioned within that portion of the composite guide bar assembly structure so as to be cooperatively engaged by the spring member. One of the primary design constraints relative to the biasing structure is that it be substantially enclosed within the primary guide member or within the nose guide member for physical protection from the external environment and to protect the operative movement of the moving parts thereof from deterioration due to moisture and other foreign elements. The protective feature of the present invention for the biasing means structure is particularly important due to the fact that design constraints typically require the biasing elements to be of relatively thin construction to accommodate the thickness requirements of the guide bar, and due to relatively close tolerances of moving parts within the enclosed internal environment for the biasing means.

A preferred embodiment of a guide bar assembly constructed according to the principles of this invention has a primary guide member that defines an internal cavity having an access port thereto formed through the distal end of the primary guide member. A forece-imparting bearing surface is established within the internal cavity, and a sheet-like spring member having one end fixed for movement with the nose guide member, has an active end thereof extending into the cavity through the distal end of the primary guide member and operatively engaging the bearing surface. In a preferred configuration of the spring member, the active end of the spring member which extends within the internal cavity is bifurcated to form a pair of finger spring members. Similarly, the force-imparting bearing surface comprises in the preferred embodiment, a pair of such bearing surfaces disposed in symetrical wedge-shaped manner, each forming an acute angle with the longitudinal axis of the guide bar member for cooperative engagement respectively with the finger spring members. As the spring member is rearwardly moved in the longitudinal direction such that the spring fingers forcibly engage the inclined bearing surfaces, biasing spring energy is stored in the finger spring members as they deflect in response to the forces imparted thereto from the bearing surfaces. The stored potential spring energy maintains a desired predetermined tension on the cutting chain by urging the nose guide member longitudinally outward against the chain as it moves along the peripheral edges of the guide bar member. As the chain expands (i.e. lengthens) during extended operative use, the stored potential spring energy is proportionately released through the biasing means and to the connecting means, moving the nose guide member away from the distal end of the primary guide bar member, to take up the chain slack and to maintain a uniform chain tension.

The desired predetermined chain tension can be varied, for a given spring configuration, by respectively changing the angle of inclination of the force-imparting bearing surfaces. In a preferred construction of the invention, the force-imparting bearing surfaces are constructed on a force block member that is sized to slide within the internal cavity of the primary guide member but which is readily removable therefrom for replacement with a different force block member having a different angular configuration for the bearing surfaces. It will be understood that while a particular configuration of the bearing surfaces and the means for implementing same are disclosed herein, other configurations for implementing the reactive surface upon which the spring or biasing member acts can equally well be configured within the spirit and intent of this invention.

Operative vibration of a chain saw using a guide bar constructed according to the principles of this invention is significantly reduced, and virtually eliminated. The present invention includes shock absorption means within the bifurcated chain saw guide bar, adjacent the juncture of the primary guide member and the nose guide member for absorbing vibratory forces transmitted through the bifurcated guide bar member in a direction transverse to the longitudinal axis of the guide bar assembly. A preferred construction of the shock absorption means of this invention includes a pair of damping finger members laterally spaced within the primary guide bar member at its distal end, and configured to slideably engage that connecting means extending from the nose guide member and into the internal cavity of the primary guide member. The connecting means comprises in the preferred construction of the invention, the rearward portion of the biasing spring member, and further includes a second pair of shock absorption fingers disposed along its outer edges for cooperatively engaging damping finger members of the primary guide member. The combined actions of the damping and shock absorption fingers effectively absorb any undesirable transverse forces imparted through the nose guide member from the chain and through the connecting means, thus preventing such vibratory forces from being transmitted through the primary guide member and back to the operator through the chain saw frame. While a particular configuration of the shock absorption feature of the invention will be disclosed herein, it will be understood that other configurations of such shock absorption means incorporating the principles of this invention can be designed within the spirit and scope of this invention.

Another feature of the present invention relates to a chain saw guide bar member incorporating improved oiling properties, heretofore not found in prior art guide bars. The improved oiling properties relate not only to thee total lubrication of the moving components of the biasing means enclosed within the guide bar member, but also to an improved oiling technique and method for lubricating the moving cutting chain just prior to its engagement with the device being acted on by the chain saw bar assembly, as well as to an improved technique and method for lubricating the idler sprocket member typically found in the nose guide portion of the guide bar. Due to the enclosed nature of the biasing means being located within the guide bar member, it is important that such biasing means be fully and continually bathed in lubricating oil to prevent moisture attack and rust thereof. The present invention provides oiling means within the primary guide member for continually bathing the biasing spring member and the force-imparting bearing surface engaged thereby. In a preferred construction of the oiling means for the spring biasing elements, an oil inlet port is formed through the outer surface of the primary guide bar member, adjacent its proximal end, and is configured for alignment with the oil injection structure typically found on the frame of the chain saw. Such oil injection system (not forming a part of this invention ) can be either of a manual pump type, or of the automatic injection type. The primary guide bar member defines an elongate oil channel continuous with the oil inlet port and extending therefrom to the internal cavity housing the spring biasing and force-imparting surface or surfaces. Oil injected into the oil inlet port flows through the oil passageway and completely bathes the spring biasing structure.

The present invention also includes an improved bar structure and method for lubricating the cutting chain adjacent the distal end of the bar structure. In a preferred embodiment configuration of the chain oiling structure the same oil inlet port and passageway employed for lubricating the biasing means is employed, and the oil passageway is extended to the distal end of the guide bar member. An oil outlet port opening through the side wall of the primary guide bar at its distal end and opening into the oil passageway enables oil passing through the passageway to flow under the force of gravity onto the cutting chain as it passes thereunder, in its return path toward the drive sprocket. The lubricating oil from the outlet port lubricates the sides and guide bar engaging surfaces of the cutting chain member, significantly reducing friction thereof with the guide bar, at a point just prior to the hard, forcible engagement of the chain member with the guide bar during a cutting operation.

The present invention includes the method involved in the lubrication of the cutting chain, comprising the steps of:

(a) introducing a charge of lubricating oil into the internal oil passageway of the guide bar assembly through the oil inlet port adjacent the proximal end of the bar;

(b) causing the introduced oil to travel through the length of the oil passageway in the guide bar assembly and through the oil outlet port; and (c) directing the oil passing through the oil outlet port onto the cutting chain adjacent the distal end of the guide bar assembly, as the chain travels thereby on a return path from the distal end of the guide bar assembly to the drive sprocket.

The invention also includes an improved apparatus and method for lubricating the idler sprocket member located in the nose guide member of the guide bar assembly. Heretofore, the idler sprocket was typically lubricated in prior art structures by means of a grease gun fitting. With the present invention, the idler sprocket can be lubricated with the same lubricating oil used for lubricating the biasing means and the cutting chain. According to a preferred construction of this feature of this invention, the nose guide member includes an oil channel formed therethrough and cooperatively connected with the oiling means channel of the primary guide bar member, whereby lubricating oil is directed from the oil passageway channel of the primary guide bar member, through the oil channel of the nose guide member and into lubricating engagement with the idler sprocket and its associated bearings.

The invention includes the improved method for lubricating the idler socket sprocket through the guide bar structure, without the need for supplemental grease gun apparatus, comprising the steps of:

(a) introducing a charge of lubricating oil into the internal oil passageway of the guide bar assembly through the oil inlet port adjacent the proximal end of the guide bar;

(b) causing the introduced oil to travel through the oil passageway, the length of the guide bar and through an oil outlet port adjacent the distal end thereof; and (c) directing the oil passing through the oil outlet port to flow into lubricating engagement with the idler sprocket.

It will be understood that many configuration of guide bar structures incorporating the unique principles of this invention can be designed within the spirit and scope of this invention. While the preferred embodiment of the present invention will be described in association with particular configurations of biasing means having particular spring and force-bearing surface configurations, shock absorption structures having particular finger-like damping elements, and specific oiling channel configurations, it will be understood that the invention is not limited to such configurations as illustrated. Further, while the oiling properties of the present invention will be described with respect to a two-piece or bifurcated chain saw guide assembly, it will be understood that the principles involved and claimed by this invention relate equally well to one-piece guide bar structures. Further, while various materials will be described as preferred for the various elements of the preferred embodiment, and while various dimensions and tolerances will be recited, it will be understood that the invention is not limited to such materials or dimensions.

Various advantages and features of novelty which characterize the invention are pointed out with particularity in the claims annexed hereto and forming a part hereof. However, for a better understanding of the invention and its advantages obtained by its use, reference should be had to the Drawing which forms a further part hereof and to the accompanying descriptive matter in which there is illustrated and described a preferred embodiment of the invention.

BRIEF DESCRIPTION OF THE DRAWING

Referring to the Drawing, wherein like numerals represent like parts throughout the several view:

FIG. 5 is a cross-sectional view of the nose guide member portion of the guide bar disclosed in FIGS. 1 and 2, as generally viewed along the Line 5—5 of FIG. 1;

FIG. 6 is an enlarged view of the nose guide member of FIG. 5, illustrated with a portion of the front protective plate member removed therefrom.

FIG. 7 is an enlarged cross-sectional view of the guide bar assembly illustrated in FIG. 3, as generally viewed along the Line 7—7 of FIG. 3;

FIG. 8 is a cross-sectional view of the guide bar assembly illustrated in FIG. 3, as generally viewed along Line 8—8 of FIG. 3; FIG. 9 is an enlarged cross-sectional view of the guide bar of FIG. 1, illustrating the means for mounting the guide bar assembly to the chain saw frame, and as generally viewed along the Line 9—9 of FIG. 1;

FIG. 10 is an enlarged cross-sectional view of the guide bar of FIG. 1, illustrating the course tension adjustment structure of the chain saw of FIG. 1, and as generally viewed along the Line 10—10 of FIG. 1;

DETAILED DESCRIPTION OF THE INVENTION

Figure 1:
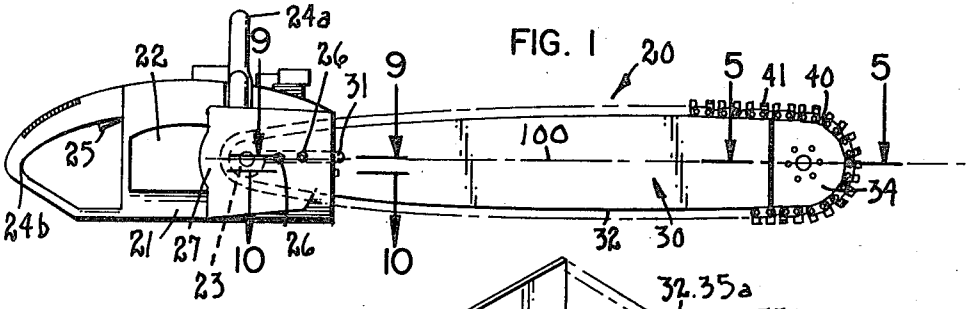
FIG. 1 is a view of side elevation of a typical portable chain saw incorporating a guide bar assembly of this invention.

Referring to FIG. 1, a portable chain saw structure incorporating the present invention is generally illustrated at 20. Such portable chain saws may assume a number of different configurations, but are typically characterized by a frame 21 upon which is mounted a prime mover, generally designated at 22, that is operatively connected to rotate a drive sprocket 23. The prime mover 22 is typically a small gasoline-powered engine that is of a physical size and horsepower rating which is compatible with the particular size of the chain saw 20, and the use of which it is to be put. Alternatively, the prime mover 22 could be an electrically operated motor. Appropriate clutch means (not illustrated) are typically provided for engaging and disengaging the drive sprocket 23 from the prime mover 22 so that the prime mover can continue to run or idle without driving the cutting chain. The chain saw 20 typically has a pair of handles **24*a* and 24*b* mounted to the frame 21 at right angles to one another for providing operative maneuverability of the chain saw. The revolutions per minute (i.e., speed) of the chain saw is typically controlled by a trigger structure, generally designated at 25**, and appropriate linkage means (not illustrated).

A guide bar assembly, generally designated at 30, (also see FIG. 2) is secured to the frame 21 of the chain saw by means of a pair of mounting bolts or studs **26*a* and companion fastening nuts 26*b*. The rearward end of the guide bar assembly 30 (hereinafter also referred to as the proximal end) has a longitudinally extending mounting slot 31 formed therein for enabling the proximal end of the guide bar assembly 30 to be fastened to the mounting bolts 26*a*. The width of the mounting slot 31 is sized slightly larger than the diameter of the mounting studs 26*a* such that the proximal end of the guide bar assembly 30 can be slid over the mounting bolts as illustrated in FIGS. 1 and 9. An end cap 27 fits over the mounting bolts 26*a* and has a pressure bearing surface 27*a* (see FIG. 9) that bears against the outer surface of the guide bar 30, sandwiching the guide bar between the end cap 27 and the frame 21 when the nuts 26*b* are fastened, thus rigidly securing the guide bar 30** for movement with the chain saw frame.

An endless articulated chain 40, carrying spaced teeth members 41 thereon serves as the cutting blade for the saw. The cutting chain is designed to track peripherally of the guide bar assembly, as is well-known in the art, and has one end thereof looped over and supported by the drive sprocket 23, such that when the prime mover is operatively engaged with the drive sprocket, the drive sprocket moves the chain, causing it to traverse along the guide bar to perform the desired sawing or severing operation. When the guide bar assembly 30 is operatively mounted to the chain saw frame 21, the the general plane of rotation of the drive sprocket is aligned with the general plane of the guide bar assembly 30. The chain 40 is provided with inwardly projecting lugs or tangs 42 (see FIG. 6) which engage teeth in the driving sprockets (not illustrated) and which are received in a peripheral groove of the guide bar, as hereinafter described in more detail.

The guide bar assembly 30 is of bifurcated construtio, having an elongated primary guide member 32, extending from the rearward or proximal end **32*a* thereof toward an oppositley disposed distal end 32*b*, and is generally symmetrically disposed about a longitudinal axis 100. A nose guide member 34 forms an operative extension of the primary guide member 32 and is moveably mounted at its distal end, as hereinafter described in more detail. The primary and nose guide members 32 and 34 respectively, cooperatively provide the peripheral guide or track along which the cutting chain 40** moves.

Figure 2:
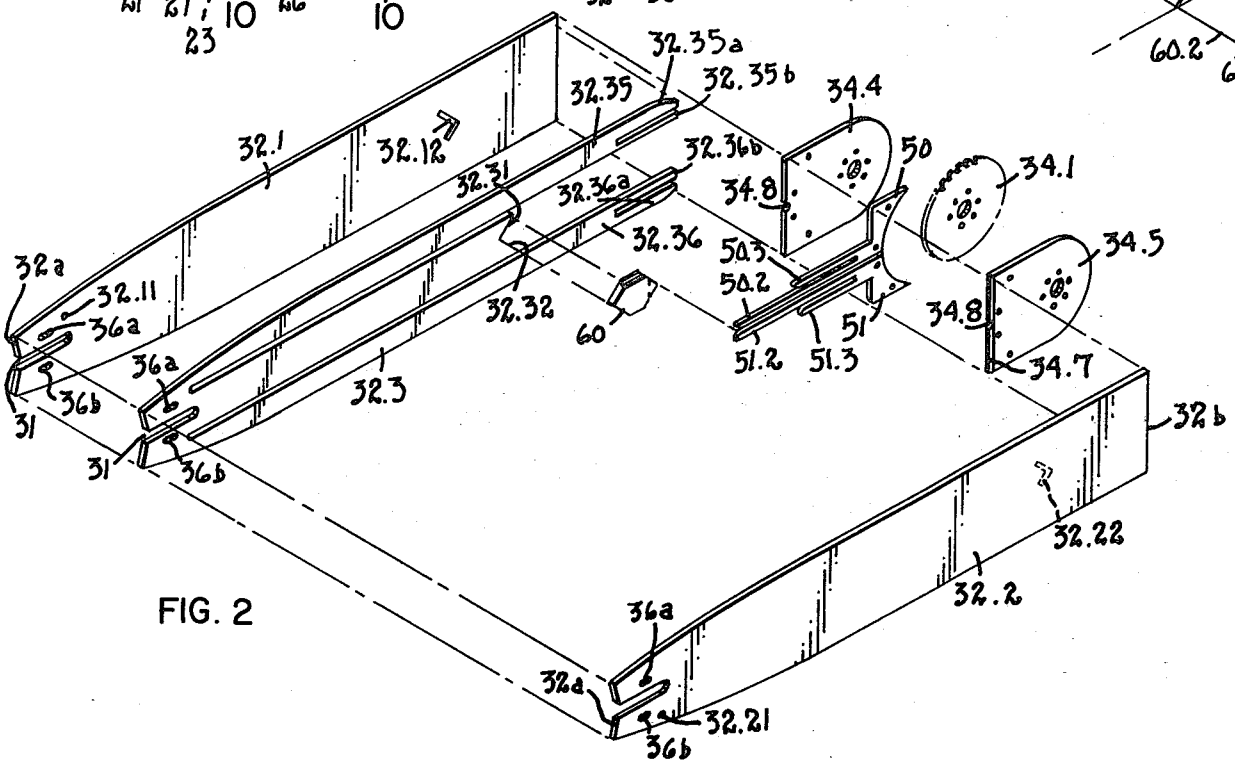
FIG. 2 is an exploded view in perspective of the bifurcated guide bar portion of the chain saw assembly of FIG. 1, constructed according to a preferred embodiment of the invention, illustrating the relative positioning of the various parts comprising the guide bar.

The primary guide member is, in the preferred embodiment configuration, constructed in laminated configuration, having (as illustrated in the Drawing) a rear outer plate member 32.1, a forward outer plate member, 32.2 and a center plate member 32.3 sandwiched therebetween (see FIG. 2). In the preferred embodiment the laminated members 32.1–32.3 comprising the primary guide member 32 are of spring steel material, with the two outer plate members 32.1 and 32.2 being tempered. The center plate member 32.3 is notched at its distal end, with the notch terminating at a pair of angularly disposed bearing surfaces 32.31 and 32.32. The notch opening into the distal end of the center plate member 32.3 divides the distal end into a pair of forwardly projecting upper and lower finger structures 32.35 and 32.36 respectively. The upper and lower finger structures are further each bifurcated into outer and inner fingers respectively 32.35*a* and 32.36*a* (outer) and 32.35*b* and 32.36*b* (inner). The inner fingers (32.35*b* and 32.36*b*) of the upper and lower finger structures provide, in part, the shock absorbing features of the invention.

A pair of narrow slots 32.33 and 32.34 respectively, longitudinally extend from a position adjacent the proximal end of the center plate member 32.3 toward an open respectively through the angular bearing surfaces 32.31 and 32.32, and form oil-channels 32.33 and 32.34 respectively. The slot 32.33 will hereinafter be referred to as the upper oil channel, and the elongate slot 32.34 will be referred to as the lower oil channel.

The outer plate members 32.1 and 32.2 are peripherally secured to the center plate member 32.3 by appropriate means such as riveting or spot welding, to collectively form the primary guide member 32. In the preferred embodiment, the three members are secured to one another by spot welding. That portion of the center plate 32.3 disposed between the upper and lower oil channels 32.33 and 32.34 is also fixedly secured to the outer plates 32.1 and 32.2, as are the outer fingers 32.35*a* and 32.36*a*. The inner fingers 32.35*b* and 32.36*b*, however, are not secured to the outer plate members 32.1 and 32.2, and are free to move in a direction transverse to the longitudinal axis 100, as hereinafter described, to absorb vibration and shock forces transmitted thereto through the guide bar assembly. When bonded together, the notch within the center plate member 32.3, forms in cooperation with the outer plate members 32.1, and 32.2 an internal cavity 33 within the primary guide member 32, having an access port thereto opening through the distal end of the primary guide member 32. Similarly, the elongate channels, 32.33 and 32.34 within the center plate member 32.3 form in combination with the outer plate members 32.1 and 32.2 elongate channels leading from the proximal end of the primary guide member 32 and opening into the internal cavity 33. These channels serve as oil flow passageways through the enlongate member 32 and provide improved lubrication of internal moving parts as well as for the cutting chain as hereinafter described. Access is provided to the upper and lower oil channels 32.33 and 32.34, through the rear and forward outer plate members 32.1 and 32.2 respectively by a pair of oil access holes generally designated at 32.11 and 32.21 respectively.

The outer plate members 32.1 and 32.2 have transverse dimensions slightly more than that of the center plate member 32.3 such that when the outer plate members are secured to the center plate member 32.3, they form in combination therewith a peripheral guide channel 35 (see FIGS. 7 and 8) in which the lugs or tangs 42 of the chain 40 are longitudinally guided along the periphery of the guide bar assembly. The chain lugs 42 do not bottom out in the peripheral channel 35, but are suspended in slightly spaced relationship above the bottom of the channel by the connecting link members 43 (see FIGS. 7 and 8). As illustrated, the bottom edge portions of the connecting link members 43 slidably engage the outer peripheral edges of the rear and forward outer plate members 32.1 and 32.2 respectively.

The outer plate members 32.1 and 32.2 each also has an oil bypass notch 32.12 and 32.22 respectively formed in their inner surfaces and disposed longitudinally therealong so as to be positioned adjacent the internal cavity 33 (see FIG. 4) for facilitating oil flow around the biasing means, to be hereinafter described. The primary guide member 32 further has a pair of alignment holes 36*a* and 36*b* formed therethru for facilitating gross tension adjustment (as hereinafter described) of the cutting chain 40 on the guide bar assembly.

The gross tensioning mechanism is described in more detail in FIG. 10. Referring thereto, it will be noted that a positioning cam or lug 37 is cooperatively threaded on a set screw 38, which in turn is mounted within the end cap 27. The positioning lug engages the alignment hole within the primary guide member 32. If the nuts 26*b* on the mounting studs or bolts 26*a* (FIG. 9) are loosened such that the blade guide bar assembly 30 is free to longitudinally move with respect thereto, the tension applied to the cutting chain 40 by the bar assembly can be roughly adjusted by turning the set screw 38, which will result in the movement of the positioning lug therealong—longitudinally sliding the guide bar to the desired position. When the desired gross adjustment is attained, the mounting bolts 26 are tightened to securely fasten the guide bar assembly in the desired position.

The nose guide member 34 has an idler sprocket 34.1 mounted for rotation thereto by an appropriate bearing member 34.2 (see FIGS. 5 and 6) that is centrally alligned on an axis perpendicular to the longitudinal axis 100. The outer periphery of the idler sprocket 34.1 has teeth circumferentially spaced so as to accept the inwardly projecting lugs or tangs 42 of the cutting chain 40, as illustrated in FIG. 6, for reversing the direction of movement of the chain 40 as it passes over the end of nose guide member 34. The idler sprocket 34.1 is sandwiched between a pair of outer plate members 34.4 and 34.5 as illustrated in FIG. 2, with the bearing 34.2 being fastened to the outer plate members by appropriate fastening means such as rivets or the like, as illustrated. The radial dimension of the forward edges of the outer plate members 34.4 and 34.5 are sized such that the outer plate members do not frictionally engage the connecting link members 43 of the chain 40 as they pass around the nose end of the idler sprocket 34.1. As is well-known in the art, it has been found that such idler sprockets significantly reduce the frictional drag of the cutting chain against the guide bar assembly as the chain passes over the forward or nose end of the guide bar assembly.

The nose guide member 34 is mounted to the distal end of the primary guide member by means of first and second finger spring members 50 and 51 respectively. The finger spring members 50 and 51 are, in the preferred embodiment, configured as mirror images of one another, each having an enlarged mounting portion 50.1 and 51.1 respectively and a pair of finger spring members projecting in bifurcated manner longitudinally rearward therefrom. The enlarged mounting portions 50.1 and 51.1 are configured for fixed sandwiched mounting between the outer plate members 34.4 and 34.5 (see FIG. 2) by appropriate mounting techniques such as riveting, or preferably spot welding, and are shaped to so as not to impede the movement of the idler sprocket 34.1. The finger spring members 50 and 51 are mounted in symmetrical relationship on either side of the longitudinal axis 100 and, in the preferred embodiment, define a passageway 39 therebetween which serves as an oil channel for lubricating the idler sprocket 34.1 and bearing 34.2, as hereinafter described in more detail. In a preferred embodiment, the first and second linger spring members are laterally spaced approximately $\frac{1}{8}$th of an inch apart along their longitudinal length.

Figures 3, 4:
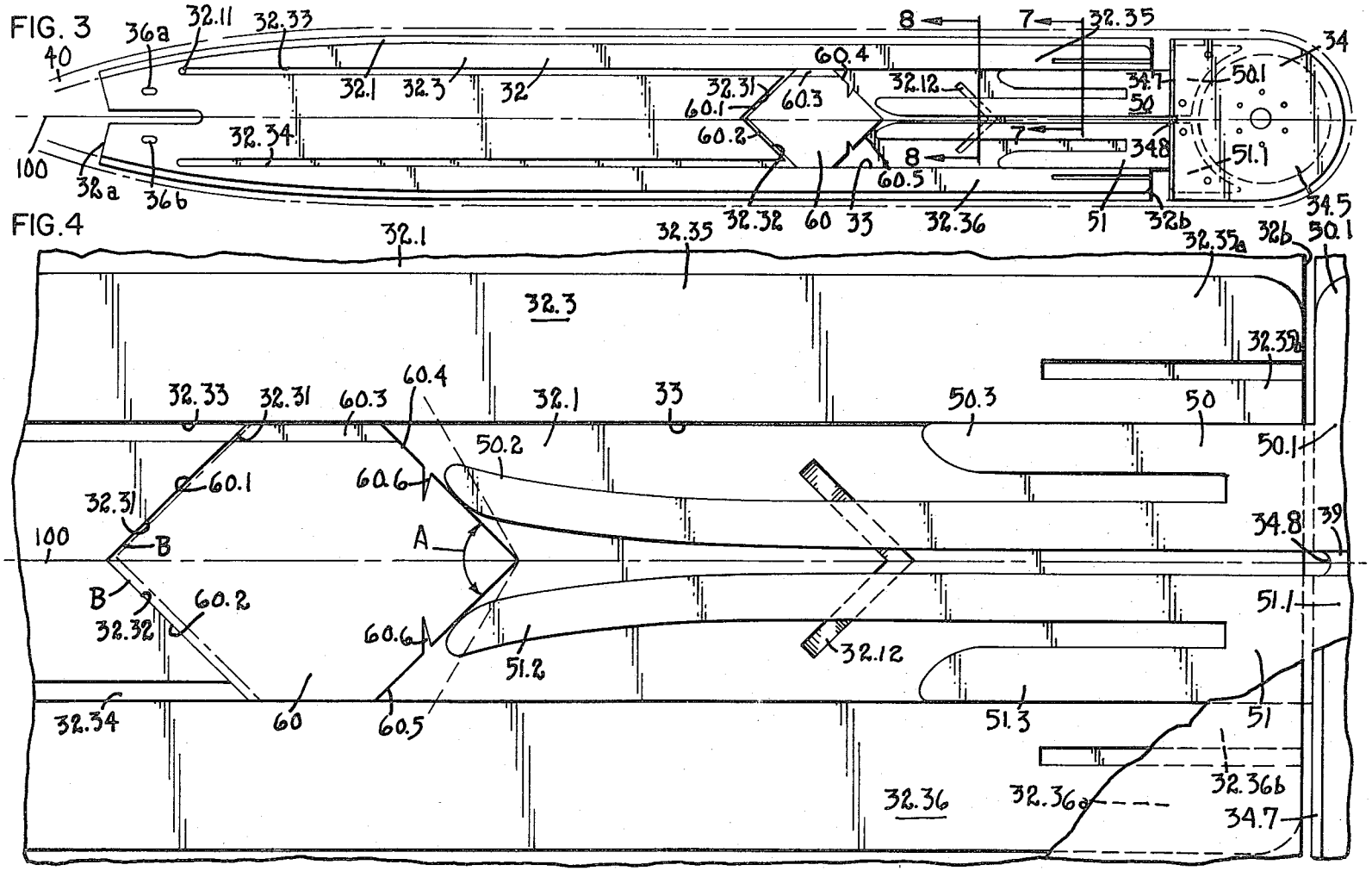
FIG. 3 is an enlarged view in side elevation of the guide bar disclosed in FIGS. 1 and 2, shown with the front protective plate member removed from the primary guide member portion of the guide bar, and illustrating the biasing elements thereof in a disengaged, non-operative position.
FIG. 4 is an enlarged fragmentary view of a portion of the guide bar structure of FIG. 3, illustrating in more detail the biasing and shock absorption features thereof, where the biasing structure is illustrated in an engaged, operative position.

The rearwardly extending finger members of the spring members 50 and 51 are each bifurcated so as to form inwardly (50.2 and 51.2) and outwardly (50.3 and 51.3) oriented finger springs respectively. The finger spring members 50 and 51 are formed from a sheet spring material having a thickness sized sufficiently thin so as to be slidably received within the internal cavity 33 of the primary guide member 32 through the opening in its distal end, as illustrated in FIGS. 3 and 4. In a preferred embodiment, the thickness of the sheet material from which the finger spring members 50 and 51 is formed is approximately 0.002 inches less than the width dimension of the internal cavity 33, to allow for relatively free movement in the longitudinal direction of the finger spring members 50 and 51 within the internal cavity, while substantially preventing any rotational movement of the finger spring members 50 and 51 about the longitudinal axis 100.

The "outer" peripheral edges of the finger springs 50.3 and 51.3 cooperatively slidably engage the inwardly directed edges of the shock absorbing finger members **32.35*b* and 32.36*b* respectively of the center plate member 32.3 (see FIGS. 3 and 4). The inner finger springs 50.2 and 51.2 rearwardly project beyond the outer finger springs 50.3 and 51.3** for engagement with a forceimparting bearing surface, hereinafter described.

Figure 11:
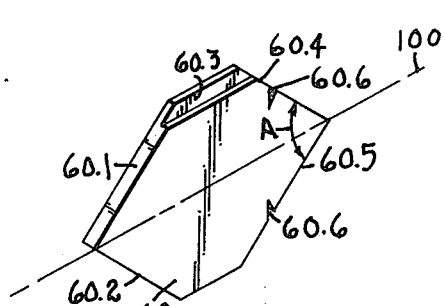
FIG. 11 is an enlarged perspective view of the bearing surface insert portion of the guide bar assembly illustrated in FIG. 2.
Figure 12:
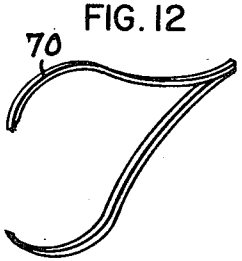
FIG. 12 illustrates a tool for removal of the bearing surface insert member disclosed in FIG. 11, from the composite guide bar assembly structure.

An insert wedge or bearing block member 60 is cooperatively slidably received within the internal cavity 33 of the primary guide member 32. The insert wedge 60 has a pair of rearwardly disposed bearing surfaces 60.1 and 60.2 (see FIG. 3) formed at an angle with the longitudinal axis 100 so as to cooperatively engage and mate respectively with the angularly disposed bearing surfaces 32.31 and 32.32 respectively of the center plate member 32.3. The insert wedge member 60 has a channel 60.3 longitudinally extending along its upper edge (see FIG. 11), that is configured to form a longitudinal extension of the upper oil channel 32.33 (see FIGS. 3 and 4) when the wedge member is operatively inserted within the inner cavity 33. The forwardly disposed surfaces 60.4 and 60.5 of the wedge 60 are angularly disposed with respect to the longitudinal axis 100 at predetermined angles with respect thereto, and form force-imparting bearing surfaces for engagement with the inner finger springs 50.2 and 51.2. In the preferred embodiment, the included angle "A" formed between the forwardly disposed bearing surfaces 60.4 and 60.5 is less than 180 degrees and preferably lies within the range of 40° to 120°. According to the preferred construction of the wedge member 60 as illustrated herein, the preferred range for the included angle "A" would be within the range of 60° to 90°. The insert wedge member 60 further has a pair of removal slots 60.6 formed within its bearing surfaces 60.4 and 60.5 and are used for facilitating removal of the wedge member 60 from the internal cavity 33 for maintenance or, for changing the size of the included angle "A" for altering the predetermined tensioning force to be applied to the chain. For such purposes a tool such as the tong member 70 illustrated in FIG. 12 could be used. The insert wedge member 60 is constructed preferably of a hard plastic or brass material, to minimize frictional engagement wear between the insert member and the finger spring members which operatively engage it.

Those rearwardly disposed edges of the outer plate members 34.4 and 34.5 of the nose guide 24 are beveled (see FIGS. 2, 3 and 4), generally designated at 34.7, and have an oil exit hole or notch 34.8 formed therethrough at the axial position thereof so as to cooperatively align with the oil passageway 39.

Referring to FIGS. 3 and 4, it will be noted that the guide bar assembly is generally symmetrically disposed about the longitudinal axis 100 such that the bar assembly can be reversibly mounted on the chain saw frame when the bottom portion of the bar becomes worn over periods of extended use. In such event, the upper oil passageway channel 32.33 will then be reversed with the position of the lower oil channel passageway 32.34, and vise versa. During operative use, only the oil channel passageway in the upper position (i.e. 32.33 in FIGS. 3 and 4) will be used. The lower oil channel passageway 32.34 is operatively blocked off within the internal cavity 33 by the insert force block member 60 (see FIG. 4). The force block 60 operatively closes the lower oil channel passageway 32.34, when it is longitudinally rearwardly urged into forcible engagement with the center plate member 32.3 by the finger spring members 50.2 and 51.2 as hereinafter described. Since the insert block 60 must freely slide into its operative position as illustrated, through the longitudinal length of the internal cavity 33, there may be a slight leakage of oil passed the lower edge of the block member 60 and into the lower oil channel 32.34, due to the dimensional tolerances of the block 60 relative to the width of internal cavity 33. To ensure that the block 60 is urged in downward direction to completely close off the lower oil channel 32.34, the rearward surfaces 60.1 and 60.2 of the block 60 may be configured so as to convergingly meet at a position slightly above that of the longitudinal axis 100 (as illustrated in dashed lines at "B" in FIG. 4), such that as the block 60 is urged into engagement with the center plate member 32.3, initial engagement of the surfaces 60.1 and 32.31 will force the body of the block 60 downwardly, ensuring blockage of the lower oil channel 32.34.

FIG. 3 illustrates the relative positioning of the movable elements of the guide bar assembly as they would appear just prior to engagement of the spring members 50 and 51 with the force block 60. FIG. 4 illustrates the relative positioning of the movable parts of the guide bar assembly as they would operatively appear when the finger spring members 50.2 and 51.2 operatively engage respectively the force-imparting bearing surfaces 60.4 and 60.5 respectively. In the preferred embodiment, the spacing between the distal end **32*b* of the primary guide member 32 and the rearward end of the nose guide member 34, as illustrated in FIG. 3, when the finger spring members 50.2 and 51.2 first engage the bearing surfaces of the force block 60, is preferably $\frac{1}{4}$ inch. The operator then adjusts the chain tension by means of the gross adjustment (via the set screw 38 and positioning lug member 37 illustrated in FIG. 10), moving the primary guide bar member 32 longitudinally forward against the retaining pressure of the chain 40 peripherally entrained thereabout, to narrow the juncture gap between the distal 32*b* of the primary guide member and the rearward edge of the nose guide member. As the primary guide member 32 is forced longitudinally forward, the finger spring members 50.2 and 51.2 forcibly engage the bearing surfaces 60.4 and 60.5 respectively. Once the finger spring members 50.2 and 51.2 are thus engaged, further turning of the adjustment screw 38 will cause the primary guide member 32 to longitudinally move the nose guide member 34 in the forward direction, so as to tighten the chain 40 between the drive sprocket 23 and the forward end of the nose guide 34. Such chain "tightening" forces are transmitted from the set screw 38 through the positioning lug member 37 to the primary guide bar member 32, through the bearing surfaces 32.31 and 32.32 of the primary guide member 32 to the force block 60, through the force block bearing surfaces 60.4 and 60.5 to the finger spring members 50.2 and 51.2 respectively, and through the spring members 50 and 51 to the connected nose guide member 34–causing the nose guide member 34 to move longitudinally in the forward direction. As the adjustment screw 38 is turned, the nose guide 34 will continue to move in the forward direction, tightening the chain 40, until the "slack" between the chain and the guide bar members is removed. Thereafter, further turning of the adjustment screw 38 in the "tightening" direction, will be translated into potential spring biasing energy within the spring members 50 and 51 as follows. When the chain 40 will no longer permit the nose guide member to move in the forward direction, as described above, with further forward movement of the primary guide member 32, the finger spring members 50.2 and 51.2 will begin to bend and to slide upwardly along the inclined bearing surfaces 60.4 and 60.5 respectively as illustrated in FIG. 4. In so doing, the wedge-shaped force block 60 spreads the finger spring members 50.2 and 51.2 as illustrated in FIG. 4**, and stores potential spring energy within the finger spring members.

In the preferred embodiment, the gross tightening operation is continued until the juncture gap (between the distal end of the primary guide member 32 and the rearward end of the nose guide member 34) has been reduced to approximately 1/16 inch. The spreading action of the finger springs 50.2 and 51.2 also causes a slight rotational moment to be transmitted to the outer finger spring members 50.3 and 51.3 respectively, causing these outer finger spring members to snugly engage the shock absorption members **32.35*b* and 32.36*b* of the center plate member 32.3. Therefore, the operative engagement of the finger spring members 50.2 and 51.2 with the force block 60 as illustrated in FIG. 4, simultaneously provides the automatic bias tension force for maintaining the cutting chain in predetermined constant tension, and ensures a snug sealing fit in the lateral direction of the outer finger spring members 50.3 and 51.3 within the internal cavity (see FIGS. 7 and 8**).

The angle of inclination of the force-imparting bearing surfaces 60.4 and 60.5 with respect to the longitudinal axis 100 defines the working tension or pressure that will be applied through the spring members 50 and 51 and the attached nose guide member 34, to the cutting chain 40. In the preferred embodiment, an included angle (A) of 60 degrees produces a working tension on the cutting chain 40 of approximately 30 pounds. The working tension proportionately increases with an increase in the included angle (A). In a preferred embodiment it has been found that the working tension applied to the cutting chain 40 increases approximately one pound for each 2 degree increase in the included angel (A). Therefore, for any given finger spring construction, the desired tensioning force to be applied to the cutting chain 40 can be predetermined, by selecting the proper included angle (A) of the force-imparting bearing surfaces 60.4 and 60.5 of the force block member 60.

As the cutting chain lengthens with increased heat relative to the guide bar 30 during operative use, the potential spring energy stored within the finger springs 50 and 51 will be converted into kinetic energy transmitted through the finger spring members 50 and 51 to the nose guide member 34, forcing the nose guide member longitudinally outward so as to increase the juncture gap between the distal end of the primary guide member 32 and the rearward edge of the nose guide member 34–to accommodate the lengthened chain. With the preferred embodiment construction, it has been found that a longitudinal movement of the nose guide member 34 in the forward direction of $\frac{1}{8}$ inch, as urged by the spring members 50 and 51 will compensate for approximately one inch of "sag" in the chain as measured in lateral distance between the chain 40 and the lower peripheral edge of the primary guide member 32. Since, in the preferred embodiment configuration, the spring biasing structure allows for approximately $\frac{1}{4}$ inch of nose guide member movement before loss of biasing pressure, the biasing configuration will accommodate chain lengthening changes of approximately 2 inches of "sag". As the chain cools, when not in use, the chain will shorten, exerting rearward longitudinal forces through the nose guide member 34, which will be translated back to the spring members 50 and 51, causing them to rebias themselves with respect to the force block 60 as previously described. The spring biasing configuration of this invention, thus maintains constant uniform chain tension of a predetermined value throughout extended periods of operative use. Chain saws employing a guide bar assembly having the biasing configuration of this invention have been found to be operable over extended periods of time, as long as an entire day, of rugged cutting operations, without requiring any readjustment of the chain tension.

Referring to FIGS. 3 and 4, it will be noted that the outward finger members 50.3 and 51.3 are sized in length and spacing relative to the inner spring members 50.2 and 51.2 respectively, so as not to engage or interfere with the operation of the inner spring members 50.2 and 51.2. As previously stated, as the inner finger spring members 50.2 and 51.2 spread apart from one another, an outward pressure is also applied to the outer finger spring members 50.3 and 51.3, creating a self-adjusting fit of these finger spring members respective to the shock absorption fingers **32.35*b* and 32.36*b*. The shock absorption finger members 32.35*b* and 32.36*b* are not secured to the outer plate members 32.1 and 32.2, and are sized to work freely in a transverse direction therebetween. Therefore, any transverse components of vibratory or shock forces transmitted through the chain or nose guide member 34 to the springs 50 and 51 are transmitted through the outer spring members 50.3 and 51.3 to the shock absorption members 32.35*b* and 32.36*b*, which collectively dampen and absorb such transverse components. Similarly, longitudinal components of vibration and shock forces transmitted through the nose guide 34 are to some extent absorbed by movement of the finger spring members 50.2 and 51.2 relative to the force block 60**. Chain saws employing the shock absorption features of the present invention have displayed extraordinary reduction in vibration levels found to be present with the same chain saw using prior art guide bar structures.

The guide bar structure of the present invention incorporates unique lubrication properties. Since the critical biasing elements of the present invention are completely enclosed within the primary guide member 32, it is important that such moving members work freely, and avoid degradation due to attack by moisture and foreign matter. As previously described, the self-adjusting fit of the spring members 50 and 51 through the access port of the internal cavity of the primary guide member 32 virtually ensures protection of the moving parts of the biasing means from foreign matter and physical abuse from the external environment. Proper lubrication of the enclosed moving parts, however, must be ensured to prevent rusting thereof do to the extreme moisture environments in which such guide bar assemblies are typically used. Referring to FIGS. 3 and 4, lubricating oil is provided to the internal cavity portion 33 of the primary guide member 32 by means of the upper oil passageway 32.33. Most chain saw structures have either an automatic oil ejection structure or a manual oil pump structure having an outlet port that can be adapted to feed lubricating oil into the oil inlet port 32.11 leading to the oil passageway 32.33. Such oil ejection systems, which are not a part of the invention, typically are used for applying lubricating oil in an effective manner to the upper peripheral race or guide 35 of the primary guide member 32 (see FIGS. 7 and 8). Referring to FIG. 3, oil injected into the oil inlet port 32.11 proceeds longitudinally along the upper oil passageway 32.33, and to the force block member 60. The oil channel 60.3 formed within the force block 60 enables the oil to flow from the upper oil passageway 32.33 and over the force block member 60, completely bathing the force block member 60 and all surfaces in engagement therewith with the lubricating oil.

If sufficient lubricating oil is injected into the inlet port 32.11, substantially the entire internal cavity 33 will be filled with oil to completely lubricate all moving parts therein. Passage of the lubricating oil around the outer surfaces of the spring members 50 and 51 is facilitated by means of the oil bypass channels 32.12 and 32.22 formed within the outer plate members 32.1 and 32.2 respectively. Complete lubrication of the internal moving parts prevents any chance of moisture contamination or rust thereof.

As mentioned above, the prior art techniques for applying lubricating oil to the cutting chain 40 have been fairly ineffective. The oil is typically applied to the upper chain guide channel 35 of the primary guide member 32, and is intended to be carried through the channel by means of the downwardly projecting lugs or tangs 42 of the chain (see FIGS. 7 and 8) as they proceed down the channel. In reality, however, the lubricating oil tends to lie at the bottom of the channel, and does not effectively lubricate the interfacing surfaces of the chain lugs 43 with the outer peripheral edges of the primary guide member 32, where the lubrication is most needed. Also, since the tangs 42 do not extend down to and engage the bottom of the guide race 35, they are generally ineffective in moving the lubricating oil longitudinally along the race. Further, much of any such lubricating oil that is carried by the tangs to the nose guide member 34 is lost to the external environment as a result of centrifugal force as the chain passes around the idler sprocket 34.1. As a result, with such prior art structures, little of the lubricating oil applied to the chain is available for effectively lubricating the chain during the power or cutting portion of its travel (i.e. along the lower peripheral edge of the primary guide member extending from the distal end of the primary guide member and back toward the drive sprocket 23. The chain lubrication technique and method of the present invention overcomes the inherent disadvantages of such prior art chain lubrication techniques.

As was previously described with respect to lubrication of the biasing components, the internal cavity 33 of the primary guide member 32 is substantially filled with lubricating oil. Referring to FIGS. 3 and 4, the bifurcated nature of the spring members 50.2 and 51.2 forms an oil passageway therebetween, leading to the oil outlet port or notch 34.8 defined within the rearward edge of the adjacent nose guide member 34. The lubricating oil within the cavity 33 passes by gravity and by internal pressure out through the oil notches 34.8 (one notch being disposed on each side of the nose guide member), and falls by gravity along the outer beveled edges 34.7 of the nose guide member 34, and onto the sides and "bottom" surfaces of the chain link members 43 as they pass thereby. This technique for lubricating the chain ensures that those surfaces of the chain links which actually engage the peripheral edge of the primary guide member 32 are lubricated, and, at a position therealong where such lubrication is most important (i.e. just before those link members are forced into hard frictional engagement with the overlying guide bar during a cutting operation). Accordingly, besides reducing wear of the peripheral edges of the guide bar and of the chain, the chain is maintained at a cooler temperature throughout the operation of the saw, thus enhancing the operation of the biasing means.

This technique for oiling the chain, in combination with the biasing structure of the invention also provides other added advantages over prior art systems. During operation of the chain saw, as the chain operatively moves along the outer peripheries of the guide bar and over the idler sprocket, the nose guide member 34 constantly moves in longitudinal reciprocatory fashion under pressure of the spring members 50 and 51 against the tension of the chain. Such slight reciprocatory movement of the spring members 50 and 51 within the internal cavity, coupled with the snug engagement of the outer finger spring members 50.3 and 51.3 with the cavity-defining walls of the primary guide bar members, acts as a pump member for positiviely ejecting small amounts of oil from the outlet oil notches 34.8 on each such reciprocatory movement. Such positive ejection ensures continual lubrication of the cutting chain, as well as providing a self-cleaning action of the access port into the internal cavity 33, the oil outlet ports 34.8 and the beveled oil directing channel surfaces 34.7.

The basic lubrication technique of causing the lubricating oil to longitudinally flow toward the distal end of the guide bar assembly, internal of the guide bar member, also provides a unique method of lubricating the idler sprocket 34.1, rotatably mounted within the nose guide member 34. In prior art guide bar structures, the rotatable bearing member portions of such idler sprockets are typically lubricated by means of grease fittings, requiring the operator to carry a grease gun with him for effecting such maintenance lubrication. With the present invention, the idler sprocket can be directly lubricated through the guide bar assembly itself, with the same lubricating oil that is used for lubricating the biasing means and the cutting chain—thus requiring the operator to only carry a single type of lubricant with him. Referring to FIGS. 3 and 4, the bifurcated mounting configuration of the finger springs 50 and 51 defines an oil passageway 39 therebetween, that provides a direct lubricating oil flow path from the oil-filled internal cavity 33, to the idler sprocket 34.1 and its cavity 33, to the idler sprocket 34.1 and its associated bearing member 34.2. An operator can easily apply lubricating oil to the idler sprocket and its associated bearing, by: introducing a charge of lubricating oil into the oil passageway 32.33 by means of the oil inlet port 32.11; causing the introduced oil to travel through the oil passageway and the internal cavity 33 and the oil passageway 39; and directing the oil passing through the oil passageway 39 onto the idler sprocket and bearing assembly. With the preferred embodiment configuration of the guide bar assembly, the operator will effect this procedure by tipping the guide bar assembly on end (non-operating) with the nose guide member 34 resting on a reactive surface, and applying downward pressure through the primary guide member, to close the juncture gap between the primary guide member and the nose guide member. This will cause lubricating oil contained within the cavity 33 to flow through the oil passageway 39 and onto the idler sprocket and bearing assembly. Oil flow through the oil passageway 39 within the nose guide member 34 will be facilitated by closing the oil outlet ports 34.8 during this process. Closing of these ports can be achieved easily by placing a finger over the outlet ports 34.8 on each side of the bar assembly.

From the foregoing description, it will be appreciated that the present invention solves many of the problems and deficiencies associated with prior art chain saw bar and lubrication structures. Besides reducing the operator discomfort and inefficiencies associated with the retensioning and oiling procedures heretofore commonplace in the prior art guide bar structures, the present invention provides for significant increases in reliability and efficiency of operation of the chain saw and guide bar strucute.

Other modifications of the invention will be apparent to those skilled in the art in light of the foregoingdescription. This description is intended to provide specific examples of individual embodiments clearly disclosed in the present invention. Accordingly, the invention is not limited to the described embodiments, or to the use of specific elements therein. All alternative modifications and variations of the present invention which fall within the spirit and broad scope of the appended claims are covered.

I claim:

1. A chain saw guide bar assembly for use with a chain saw of the type of having an endless toothed chain, a frame, a drive sprocket rotatably mounted on said frame and supporting said chain, means for mounting said guide bar assembly to said frame such that said chain is guided by and moves along the periphery of said guide bar assembly in response to rotation of said drive sprocket; said guide bar assembly comprising:

(a) a bifurcated guide bar, comprising:

(i) an elongate primary guide member having a proximal end configured for mounting to the frame adjacent the drive sprocket and an oppositely disposed distal end, whereby said primary guide member when mounted to said frame extends from said frame in cantilevered manner toward said distal end;

(b) means for movably connecting said nose guide member to said primary guide member at said distal end thereof for movement with respect thereto substantially only in the axial direction of said primary guide member; whereby the chain will operatively move along the outer peripheries of the primary and the nose guide member;

(c) biasing means enclosed within said bifurcated guide bar for automatically applying uniform predetermined tensioning forces to the cutting chain by controllingly urging said nose guide member primarily in the axial direction away from the distal end of said primary guide bar member; wherein said biasing means is shielded from the external environment of said bifurcated guide bar during operation thereof; and (d) means for preventing accummulation of sawdust and foreign matter during operation of said bar assembly that would impede the relative operative movement of said primary and nose guide members and the operation of said biasing means, whereby said uniform predetermined tensioning forces to the cutting chain are maintained.

2. A chain saw guide bar assembly as recited in claim 1, wherein one of said guide members defines a force-imparting bearing surface; and wherein said biasing means includes a spring member mounted for movement with the other of said guide members and oriented for detachable engagement with said force-imparting bearing surface.

3. A chain saw guide bar assembly as recited in claim 2, wherein said force-imparting bearing surface is formed within said primary guide member; and wherein said spring member is mounted for a movement with said nose guide member.

4. A chain saw guide bar assembly as recited in claim 3, wherein said sawdust accummulation prevention means includes oiling means formed within said primary guide member for continually bathing said force-imparting bearing surface and the portion of said spring member that engages said bearing surface.

5. A chain saw guide bar assembly as recited in claim 3, wherein said spring member is rigidly secured to said nose guide member.

6. A chain saw guide bar assembly as recited in claim 2, wherein at least a portion of said force-imparting bearing surface engaged by said spring member is inclined at an angle with respect to the longitudinal axis of said bifurcated guide bar.

7. A chain saw guide bar assembly as recited in claim 1, wherein said biasing means includes a generally planar spring member of sheet-like material, wherein the general plane of said spring member lies in the general plane of said bifurcated guide bar.

8. A chain saw guide bar assembly as recited in claim 7, wherein said bifurcated guide bar defines oil channel means having an oil inlet port suitable for receiving a flow of lubrication oil from an oil source external of said guide bar, and an oil passageway connected to said oil inlet port for maintaining said biasing means in a protective oil bath during operative use.

9. A chain saw guide bar assembly as recited in claim 7, wherein said primary guide member defines an internal cavity having an access port thereto formed through said distal end; wherein said biasing means includes a force-imparting bearing surface within said cavity; and wherein said spring member operatively engages said bearing surface and transmits tensioning forces therefrom to said nose guide member.

10. A chain saw guide bar assembly as recited in claim 9, wherein said spring member is mounted for movement with said nose guide member and has a portion thereof extending into said cavity through the distal end of said primary guide member for engaging said bearing surface; and means for shielding said internal cavity from the external environment, while permitting reciprocal movement of said spring member through the access port thereof.

11. A chain saw guide bar assembly as recited in claim 10, wherein said extended portion of said spring member is longitudinally bifurcated to define a pair of finger spring members.

12. A chain saw guide bar assembly as recited in claim 11, wherein said force-imparting bearing surface includes at least one surface operatively disposed at an angle with the longitudinal axis, and wherein at least one of said finger springs engages said angular surface.

13. A chain saw guide bar assembly as recited in claim 12, wherein said force-imparting bearing surface defines a pair of angularly disposed force-imparting surfaces, each defining an acute angle with the longitudinal axis; and wherein each of said finger springs operatively engages one each of said angularly disposed bearing surfaces.

14. A chain saw guide bar assembly as recited in claim 1, further including shock absorption means within said bifurcated chain saw guide bar adjacent the juncture of said primary and said nose guide members, for absorbing vibratory forces transmitted through said bifurcated guide bar member in a direction transverse to the longitudinal axis of the guide bar.

15. The apparatus recited in claim 14, wherein said shock absorption means comprises at least one damping member disposed within said primary guide bar member near said distal end thereof.

16. The apparatus recited in claim 14, wherein said shock absorption means comprises a pair of damping finger members laterally spaced within said primary guide bar member near said distal end thereof and disposed to operatively engage said means operatively connecting the nose guide member to said primary guide member.

17. A chain saw guide bar assembly for use with a chain saw of the type of having an endless toothed chain, a frame, a drive sprocket rotatably mounted on said frame and supporting said chain, means for mounting said guide bar assembly to said frame such that said chain is guided by and moves along the periphery of said guide bar assembly in response to rotation of said drive sprocket; said guide bar assembly comprising:

(a) a bifurcated guide bar, comprising:

(i) an elongate primary guide member having a proximal end configured for mounting to the frame adjacent the drive sprocket and an oppositely disposed distal end, whereby said primary guide member when mounted to said frame extends from said frame in cantilevered manner toward said distal end;

(b) means for movably connecting said nose guide member to said primary guide member at said distal end thereof for movement with respect thereto substantially only in the axial direction of said primary guide member; whereby the chain will operatively move along the outer peripheries of the primary and the nose guide member; and (c) biasing means enclosed within said bifurcated guide bar for automatically applying uniform predetermined tensioning forces to the cutting chain by controllingly urging said nose guide member in the axial direction away from the distal end of said primary guide bar member; wherein said biasing means is shielded from the external environment of said bifurcated guide bar during operation thereof; and wherein said biasing means includes:

(i) a force block member removably insertable within one of said guide members, said force block member defining a force-imparting bearing surface; and (ii) a spring member operatively disposed to reactively engage said bearing surface and to urge said primary and said nose guide members in a direction away from each other in response thereto.

18. A chain saw guide bar assembly as recited in claim 17, wherein the force-imparting bearing surface is inclined to define an acute angle with the longitudinal axis of said bifurcated guide bar; wherein the predetermined biasing force exerted by said spring member on said nose guide member is a function of the angle of said bearing surface with respect to said longitudinal axis; whereby the predetermined biasing force can be varied by varying inclination angle of said bearing surface.

19. A chain saw guide bar assembly as recited in claim 17, wherein said force block member is configured to define a pair of said force-imparting bearing surfaces, each of said surfaces being inclined at an angle with respect to the longitudinal axis of said bifurcated guide bar and forming an included angle between said bearing of less that 180 degrees.

20. A chain saw guide bar assembly as recited in claim 19, wherein the included angle between said bearing surfaces lies within the range of 40 degrees to 120 degrees.

21. A chain saw guide bar assembly as recited in claim 19, wherein said pair of force-imparting bearing surfaces are symetrically angularly disposed with respect to each other about said longitudinal axis.

22. A chain saw guide bar assembly as recited in claim 19, wherein said spring member further includes a pair of finger spring members, one each of said spring members being configured to operatively engage in biasing manner one each of said pair of force-imparting bearing surfaces.

23. A chain saw guide bar assembly as recited in claim 17, wherein said force block member includes removal means for facilitating removal of said block member from within said bifurcated guide bar.

24. A chain saw guide bar assembly as recited in claim 20, wherein the included angle between said bearing surfaces lies within the range of 60 degrees to 90 degrees.

25. An improved chain saw guide bar assembly for use with a chain saw of the type having an endless articulated chain having a plurality of cutting teeth serially connected by interconnecting link members, a frame, a drive sprocket rotatably mounted on said guide bar assembly to said frame such that said chain is guided by and moves along the periphery of said guide bar assembly in response to rotation of said drive sprocket, in a manner such that the interconnecting chain links slideably engage the periphery of said guide bar assembly; said guide bar assembly comprising:

(a) a bifurcated guide bar, comprising:

(i) an elongate primary guide member having a proximal end configured for mounting to the frame adjacent the drive sprocket and an oppositely disposed distal end, whereby said primary guide member when mounted to said frame extends from said frame in cantilevered manner toward said distal end;

(ii) a nose guide member configured to form an operative extension of said primary guide member at said distal end thereof;

(b) means for movably connecting said nose guide member to said primary guide member at said distal end thereof for movement with respect thereto substantially only in the axial direction of said primary guide member; whereby the chain will operatively move along the outer peripheries of the primary and the nose guide members;

(c) biasing means enclosed within said bifurcated guide bar for automatically applying uniform predetermined tensioning forces to the cutting chain by controllingly urging said nose guide member in the axial direction away from the distal end of said primary guide bar member; wherein said biasing means is shielded from the external environment of said bifurcated guide bar during operation thereof;

(d) oiling means within said guide bar assembly for lubricating said cutting chain adjacent the distal end of said primary guide bar member as the chain returns to the drive sprocket, wherein said oiling means is further characterized by said primary guide bar member being configured to define:

(i) an oil inlet port adjacent the proximal end of said primary guide bar member, suitable for receiving a charge of lubricating oil from a source external of said guide bar assembly;

(ii) an oil passageway operatively connected to said inlet port and extending through said primary guide bar member to the distal end thereof; and (iii) an oil outlet port adjacent the distal end of the primary guide bar member and operatively opening into said oil passageway, for enabling oil passing through said passageway to flow under the force of gravity onto said underlying chain; whereby those surfaces of said chain links that slideably engage the periphery of the guide bar assembly are lubricated just prior to engagement of the cutting teeth carried by those links with an object being cut thereby during normal cutting operations; and (e) means within said primary guide bar member operatively connected with said oil passageway for maintaining a positive pressure of said oil within said passageway and for ejecting a charge of said oil flowing through said passageway out of said oil inlet port.

26. An improved chain saw guide bar assembly as recited in claim 25, further including oil guide means adjacent said distal end of said primary guide bar for directing oil flow from said oil outlet port to said chain links.

27. An improved chain saw guide bar assembly as recited in claim 26, wherein that transverse edge of said nose guide member lying adjacent to the proximal end of said primary guide bar member is beveled and cooperatively addresses said oil outlet port to form said oil guide means.

28. An improved chain saw guide bar assembly as recited in claim 25, wherein said primary guide bar member defines an internal cavity common with said oil passageway and having an access port thereto formed through said distal end of said primary guide bar member; wherein said connecting means includes a bar member operatively connected to said nose guide member and extending within and slideably received by said internal cavity through said access port, in close frictional engagement with the primary guide bar member at the distal end thereof; wherein said biasing means is operatively connected to said bar member such that said bar member moves longitudinally within the internal cavity, in reciprocal manner under biasing tension of the biasing means during operation of the saw; whereby the reciprocal movement of said connecting means periodically forms a vacuum which acts upon oil in the oil passageway, ejecting said oil through said oil outlet port.

29. An improved chain saw guide bar assembly as recited in claim 24, wherein said nose guide member includes an idler sprocket mounted for rotation about an axis perpendicular to the longitudinal axis of said guide bar assembly, whereby the cutting chain passes over and is guided by the idler sprocket as the chain passes over the forward end of the nose guide member; and wherein said nose guide member includes an oil channel formed therethrough and cooperatively connected with said oiling means of said primary guide bar member, whereby lubricating oil is directed by said oiling means of the primary guide bar member through said oil channel of the nose guide member for lubricating the idler sprocket.

30. An improved method for lubricating an idler sprocket of a chain saw guide bar assembly of a portable chain saw of the type having an endless toothed chain, a frame, a drive sprocket rotatably mounted on said frame and supporting said chain, an elongate guide bar assembly extending between first and second ends, an idler sprocket mounted for rotation adjacent said second end of the guide bar assembly, said guide bar assembly being of a type having an internal oil passageway extending through said guide bar assembly from an oil inlet port adjacent said first end thereof to an oil outlet port adjacent said idler sprocket and being bifurcated into primary and nose guide members connected by connecting means reciprocally mounted for longitudinal movement within said internal oil passageway, means for mounting the primary guide bar member at its first end to the frame such that the guide bar assembly extends in cantilevered manner toward said second end thereof and such that the chain is guided by and moves along the periphery of the guide bar assembly and over the idler sprocket in response to rotation of said drive sprocket, said method comprising the steps of:

(a) introducing a charge of lubricating oil into the internal oil passageway of the guide bar assembly through the oil inlet port adjacent the first end of the guide bar;

(b) causing the introduced oil to travel through the oil passageway, the length of the guide bar and through that oil outlet port adjacent the second end thereof;

(c) directing the oil passing through the oil outlet port to flow into lubricating engagement with the idler sprocket; and (d) maintaining a positive oil pressure within said oil passageway for preventing entry of sawdust or foreign matter into said oil passageway and for preventing accummulation of such sawdust or foreign matter that would inhibit operation of said connecting means.

31. The method as recited in claim 30, further including the step of blocking flow of oil through any outlet ports operatively connected with said oil passageway and disposed therealong other than through said oil outlet port lying adjacent the idler sprocket.

32. The method as recited in claim 30, wherein the step of causing the oil to flow through the guide bar comprises the step of elevating the guide bar assembly on end, with said first end being positioned relatively higher that said second end thereof; whereby said introduced oil within said oil passageway will flow by gravity therethrough, from said oil inlet port to said oil outlet port.

* * * * *

UNITED STATES PATENT AND TRADEMARK OFFICE

CERTIFICATE OF CORRECTION

PATENT NO. : 4,361,960

DATED : December 7, 1982

INVENTOR(S) : James E. Halverson

It is certified that error appears in the above-identified patent and that said Letters Patent are hereby corrected as shown below:

In Claim 1, at column 19, line 69, after subparagraph (i), insert the following subparagraph:

--(ii) a nose guide member configured to form an operative extension of said primary guide member at said distal end thereof;--

Signed and Sealed this

Tenth Day of January 1984

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,361,960

DATED : December 7, 1982

INVENTOR(S) : James E. Halverson

It is certified that error appears in the above-identified patent and that said Letters Patent are hereby corrected as shown below:

In Claim 1, at column 19, line 69, after subparagraph (i), insert the following subparagraph:

--(ii) a nose guide member configured to form an operative extension of said primary guide member at said distal end thereof;--

In Claim 17, at column 21, line 61, after subparagraph (i), insert the following subparagraph:

--(ii) a nose guide member configured to form an operative extension of said primary guide member at said distal end thereof;--

This certificate supersedes Certificate of Correction issued January 10, 1984.

Signed and Sealed this

*Seventeenth* Day of *July 1984*

[SEAL]

*Attest:*

GERALD J. MOSSINGHOFF

*Attesting Officer*

*Commissioner of Patents and Trademarks*